US008015653B2

(12) United States Patent
Bargiel et al.

(10) Patent No.: US 8,015,653 B2
(45) Date of Patent: Sep. 13, 2011

(54) APPLICATOR DEVICE

(75) Inventors: Michael Bargiel, West Bend, WI (US); Joshua J. Nelson, Milwaukee, WI (US); Glenn Walters, Grafton, WI (US); Frank Pollard, Long Groove, IL (US)

(73) Assignee: Dusa Pharmaceuticals, Inc., Wilmington, MA (US)

( * ) Notice: Subject to any disclaimer, the term of this patent is extended or adjusted under 35 U.S.C. 154(b) by 1083 days.

(21) Appl. No.: 11/331,250

(22) Filed: Jan. 12, 2006

(65) Prior Publication Data

US 2007/0157408 A1 Jul. 12, 2007

(51) Int. Cl.
*A47K 7/03* (2006.01)
*A61M 35/00* (2006.01)

(52) U.S. Cl. ..... 15/144.2; 15/104.94; 15/144.3; 15/210.1

(58) Field of Classification Search ..... 15/104.94, 15/144.2, 144.3, 172, 209.1, 210.1
See application file for complete search history.

(56) References Cited

U.S. PATENT DOCUMENTS

| | | | | | |
|---|---|---|---|---|---|
| 2,983,369 | A | * | 5/1961 | Rogovin | 206/209 |
| 3,016,556 | A | * | 1/1962 | Greenleaf | 15/229.8 |
| 4,077,725 | A | * | 3/1978 | Slautterback | 401/17 |
| 4,291,697 | A | | 9/1981 | Georgevich | |
| 4,381,766 | A | * | 5/1983 | Avolio | 601/138 |
| 4,483,636 | A | * | 11/1984 | Meyer | 401/266 |
| D294,202 | S | | 2/1988 | Adair | |
| 4,878,775 | A | | 11/1989 | Norbury et al. | |
| 5,003,659 | A | * | 4/1991 | Paepke | 15/229.13 |
| 5,024,325 | A | * | 6/1991 | Gundlach | 206/229 |
| 5,360,111 | A | * | 11/1994 | Arispe | 206/361 |
| 5,388,700 | A | | 2/1995 | Per-Lee | |
| 5,437,372 | A | | 8/1995 | Per-Lee | |
| 5,568,669 | A | * | 10/1996 | Godown | 15/143.1 |
| 5,592,714 | A | * | 1/1997 | Bernard | 15/230.11 |
| D384,436 | S | | 9/1997 | Kelley | |
| 5,671,497 | A | * | 9/1997 | Abdo | 15/144.1 |
| 5,673,455 | A | | 10/1997 | Per-Lee et al. | |
| D388,535 | S | | 12/1997 | Per-Lee | |
| 6,159,487 | A | * | 12/2000 | Znaiden et al. | 424/402 |
| 6,336,241 | B1 | * | 1/2002 | Wilson | 15/144.2 |
| 6,338,855 | B1 | | 1/2002 | Albacarys et al. | |
| 6,415,470 | B1 | * | 7/2002 | Ramrattan | 15/144.4 |
| 6,428,799 | B1 | | 8/2002 | Cen et al. | |
| 6,769,153 | B1 | * | 8/2004 | Post et al. | 15/220.1 |
| 6,830,552 | B1 | | 12/2004 | Gonzalez | |
| 6,851,154 | B1 | | 2/2005 | Neff | |
| 2005/0175677 | A1 | * | 8/2005 | Walters et al. | 424/443 |
| 2006/0010625 | A1 | * | 1/2006 | Tapper et al. | 15/97.1 |
| 2007/0074363 | A1 | * | 4/2007 | Stewart | 15/210.1 |
| 2007/0130709 | A1 | * | 6/2007 | Cohen et al. | 15/105 |

OTHER PUBLICATIONS www.pacwestserv.com/bathtools01_earththerapeutics.htm.

* cited by examiner

*Primary Examiner* — Randall Chin
(74) *Attorney, Agent, or Firm* — Vinson & Elkins LLP

(57) ABSTRACT

An applicator device for applying a substance to an area of the body that is difficult to reach includes a collapsible handle and a head portion rotatably mounted on one end. The head portion includes an attachment means, which can comprise either a field of hooks or a field of loops. The attachment means receives a two-sided pad engagement member that preferably has fields of loops or hooks on one side to engage the respective hooks or loops of the attachment member, and a field of hooks on its opposite side. The hooks of the pad engagement member can securely retain a pad that carries the substance to be applied to the body.

9 Claims, 3 Drawing Sheets

APPLICATOR DEVICE

This invention relates to a device for applying a substance to a body. More particularly, this invention relates to a device for applying a substance to a portion of the body that is difficult to reach, such as the back.

BACKGROUND OF THE INVENTION

Many people apply substances to their skin to treat conditions of the skin and to promote general health and well-being of the skin. These substances are frequently in the form of lotions, creams, solutions or ointments. These substances may need to be applied to certain portions of the body that are difficult for an individual to reach, such as certain areas of the back.

In addition, certain areas of the skin that need treatment may harbor bacteria or other pathogens. It is therefore possible that some of these pathogens could be transferred to an applicator device and then come into subsequent contact with the skin when the applicator device is directed to a different portion of the body. It would therefore be desirable to provide such an applicator device in which the portion that physically contacts the skin is disposable yet securely fastened to the applicator device while in use. It would further be desirable to provide such a device that would prevent transmission of pathogens from the applicator pad to the applicator device.

SUMMARY OF THE INVENTION

An applicator device of a present invention comprises a handle having a first end and a second end and a head portion rotatably attached to the first end of the handle. The head portion has an attachment means for releasably securing a pad engagement member mounted on one of its surfaces. The attachment means for releasably securing a pad engagement member can be a portion of loop bearing material that can be adhesively mounted to the head portion. The handle can be collapsible and can be made of a plurality of interlocking segments. The interlocking segments can be substantially configured as hollow tubes. An elastic connecting means can extend through the hollow interiors of the tubes to facilitate rapid assembly of the segments into an operable handle.

In another aspect the invention comprises a kit. The kit comprises an applicator device as described, a pad engagement member that is releasably securable to the attachment means on the head portion, and one or more pads that can be secured to the pad engagement member to apply a substance to the body. The pad engagement member can be a substantially flat piece having two opposing sides with fields of hooks on each of the opposing sides. One field of hooks can attach to the attachment means on the head portion of the applicator device. The other field of hooks can receive a disposable pad that serves as a carrier for the substance to be applied to the body. Both the pads and the pad engagement members can be disposable to prevent the transmission of pathogens from one portion of the body to another portion of the body, and from the pad to the applicator device.

DETAILED DESCRIPTION OF THE INVENTION

Figure 1:
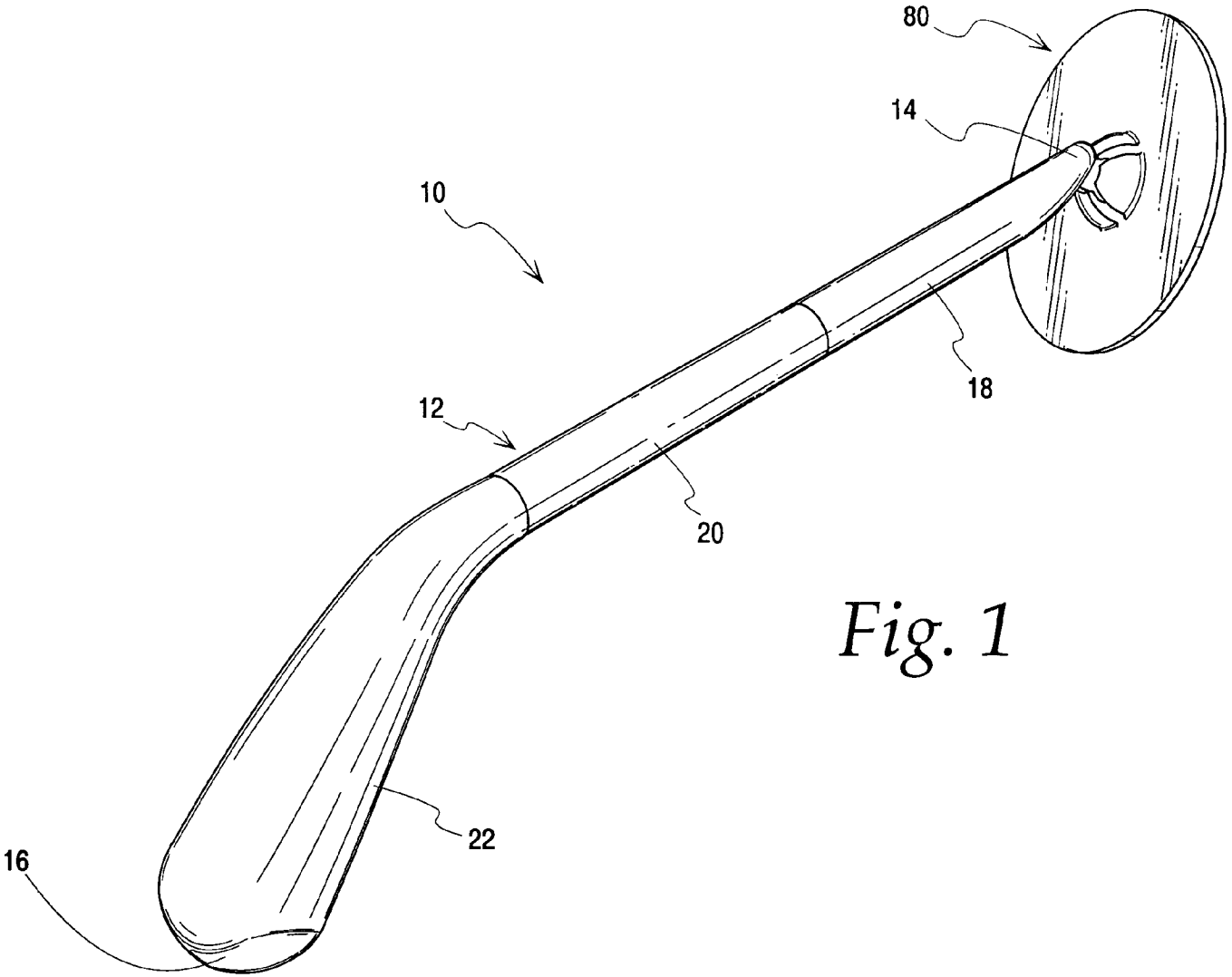
FIG. 1 is a rear perspective view of the applicator device of the present invention in the assembled configuration.
Figure 2:
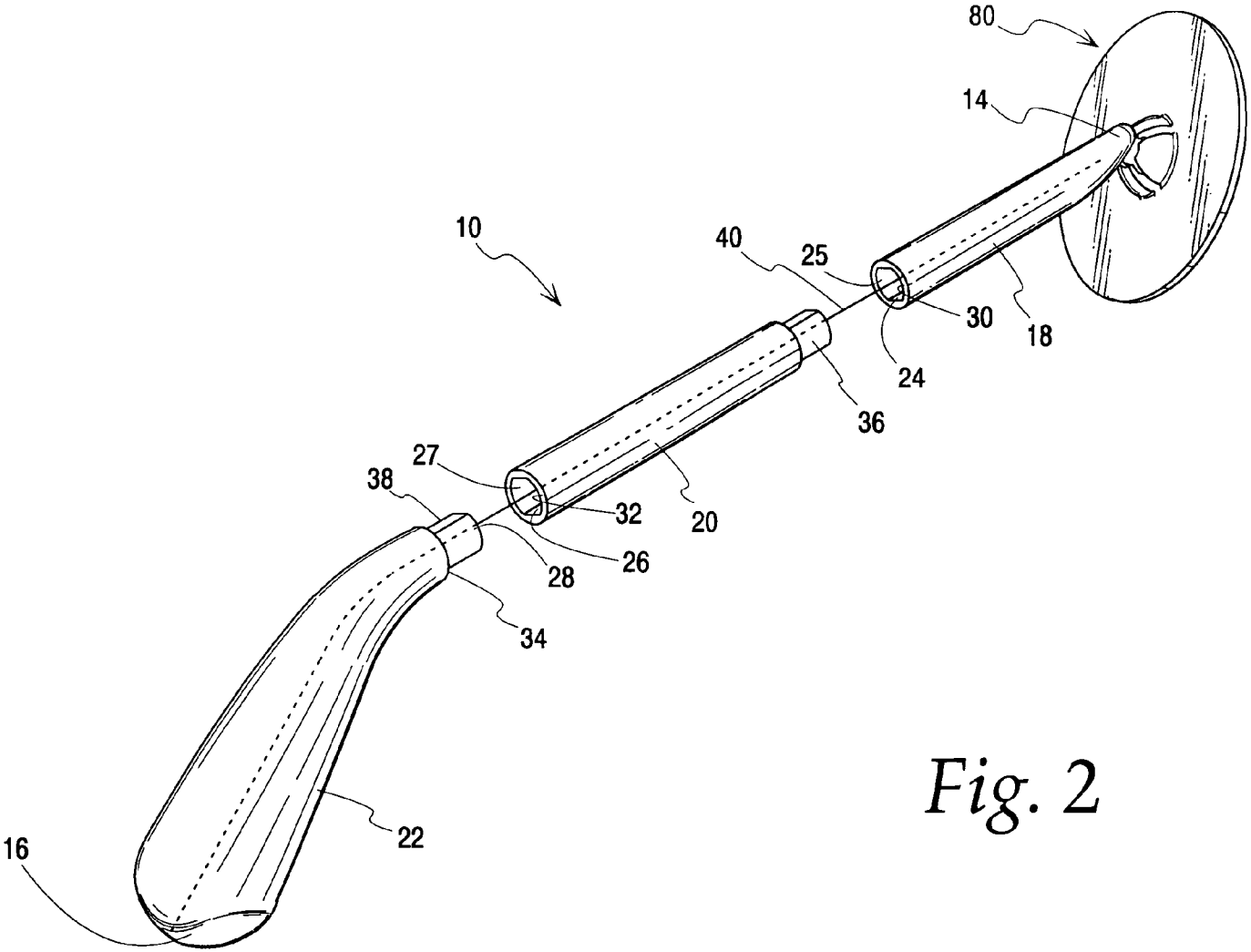
FIG. 2 is an exploded view of the device of FIG. 1.

Referring to FIGS. 1 and 2, an applicator device 10 of the present invention comprises a handle 12 and a head portion 80. The handle 12 includes a first end 14 and a second end 16. The handle may comprise a plurality of interlocking segments. In the illustrated embodiment there are three such segments indicated at 18, 20 and 22. Each of these segments is substantially in the form of a hollow tube having interior regions 24, 26 and 28, respectively, and circumferential walls 30, 32 and 34 respectively. As illustrated in FIG. 2, extending from the circumferential wall 32 of segment 20 is a neck member 36 which fits into opening 25 of the hollow region 24 of segment 18. Similarly, extending from segment 22 is a neck member 38 which fits into opening 27 of the hollow region 26 of segment 20. As illustrated in FIG. 2, each neck member 36, 38 is of a non-circular cross-section, and the openings 25, 27, respectively, into which they fit are also of a complementary non-circular cross-section so as to prevent undesirable axial rotation of the various segments with respect to one another during use of the applicator device. A connecting means preferably in the form of an elastic thread 40 extends from the interior of first end 14 of the handle to the interior of second end 16 of the handle. The elastic connecting means 40 maintains segments 18, 20 and 22 of the handle in operative relation to one another when the applicator device is in use but allows for quick collapsing of the handle for easy storage.

Figure 4:
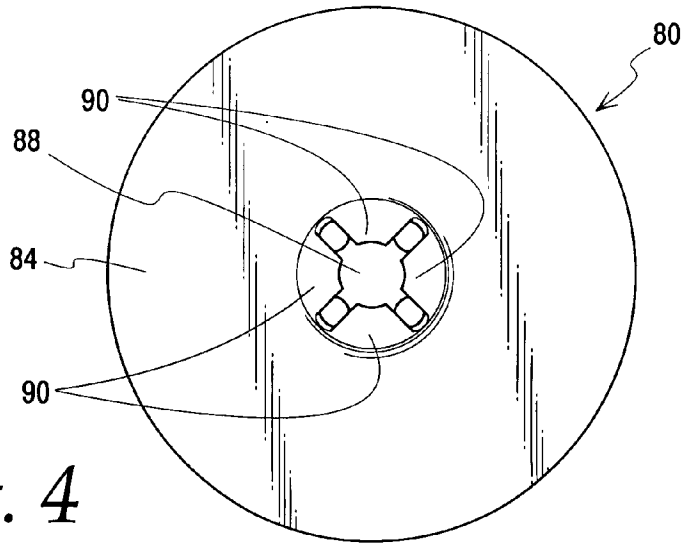
FIG. 4 is a rear view of the head portion of the device.
Figure 3:
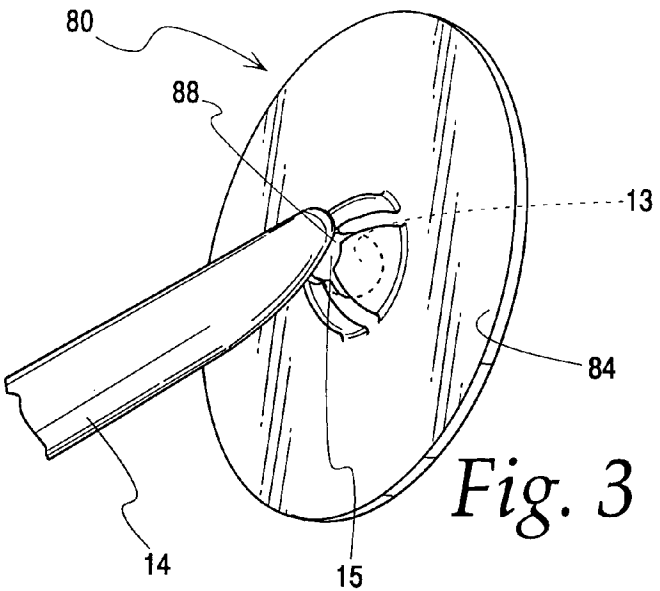
FIG. 3 is an enlarged rear perspective view of the head portion of the applicator device shown assembled to the handle.
Figure 5:
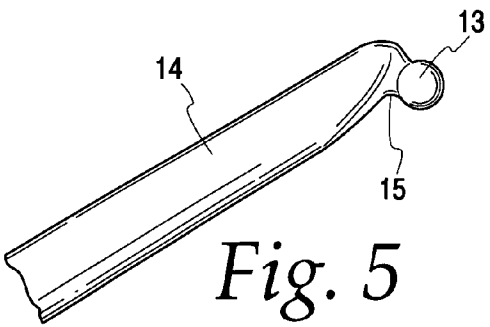
FIG. 5 is an enlarged view of the first end of the handle of the device.

Referring to FIGS. 3-5, the first end 14 of the handle 12 has a substantially spherical knob 13 connected to a narrower neck portion 15. Substantially spherical knob 13 serves as a mounting means for head portion 80.

Head portion 80 has first and second opposed surfaces 82, 84. Extending from second surface 84 is a socket 88, which in the illustrated embodiment is formed of four identical prongs 90, although it will be understood that other numbers of prongs could be used, as long as the prongs form an effective socket 88. Socket 88 receives spherical knob 13 on first end 14 of handle 12 in snap fitting relationship, such that the ends of the socket prongs 90 nest against narrow neck portion 15. Spherical knob 13 and socket 88 function as a ball-and-socket joint, which allows substantially free rotation of head portion 80 with respect to handle 12. This provides greater maneuverability and ease of use.

Figure 6:
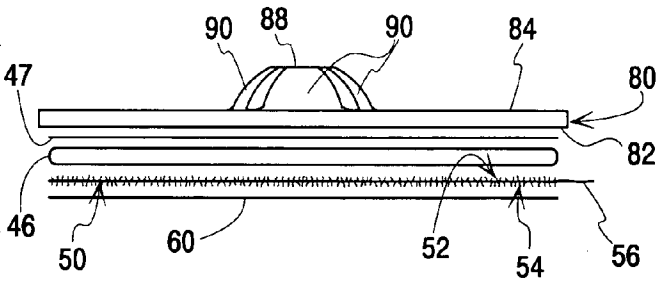
FIG. 6 is an exploded side elevation view of the head portion with pad engagement member and pad.
Figure 7:
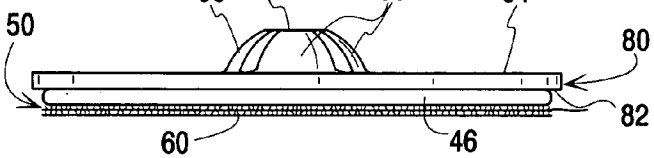
FIG. 7 is a side elevation view of the head portion showing the pad engagement member and pad assembled thereto.

Referring now to FIGS. 6 and 7, first surface 82 of head portion 80 is provided with an attachment means for releasably securing a pad engagement member. This attachment means can be, for example, in the form of a field of hooks or a field of loops such as may be provided as a portion of hook or loop-bearing material 46 mounted to surface 82, such as with an adhesive layer 47. The hook or loop bearing material 46 can be sized and dimensioned to be somewhat smaller than first surface 82 such that the perimeter of hook or loop-bearing material 46 lies within the perimeter of first surface 82.

FIGS. 6 and 7 illustrate how a pad engagement member 50 and pad 60 can be used with the applicator device of the present invention. Pad engagement member 50 is substantially flat and of the same size and shape as the field of hooks or loops on the attachment means. Pad engagement member

50 also can be provided with an optional tab 56 that extends beyond the perimeter of first surface 82 to facilitate removal of pad engagement member 50 from head portion 80. Pad engagement member 50 has opposed first and second surfaces 52 and 54. First surface 52 will comprise either a field of hooks or a field of loops, depending on whether attachment means 46 comprises either a field of loops or a field of hooks, respectively. In the illustrated embodiment, the attachment means comprises a field of loops 46, and first surface 52 comprises a field of hooks, but it will be appreciated that the relative positions of the hooks and loops can be reversed on the various components of the inventive device. Second surface 54 of pad engagement member 50 is provided with a field of hooks. The first surface 52 is used to releasably attach pad engagement member 50 to the attachment means. The field of hooks on surface 54 can then securely engage a pad 60 that serves as a carrier for the substance to be applied to the skin.

Both pad 60 and pad engagement member 50 preferably are disposable. Pad 60 can be an absorbent material such as cloth or certain paper materials that can be saturated with or otherwise carry the substance to be applied to the body. A pad 60 can be applied to a pad engagement member 50, used once, and then discarded. Any pathogens such as bacteria that are on the skin will not be reapplied to the skin upon later use. The pad engagement member 50 can be made of a non-porous plastic material such that neither any substance to be applied to the body nor any pathogens from the skin are transferred through pad engagement member 50 to the attachment means 46.

In another aspect, the invention can be provided as a kit. The kit includes the applicator device 10 as described, a supply of pad engagement members 50, and a supply of pads 60. If desired, the pad 60 can be pre-saturated with the substance to be applied to the body. For example, the pads 60 can be provided in a jar containing a liquid substance to be applied to the body, such that each pad 60 is saturated with the substance. Alternatively, each pad 60 as supplied in the kit can be free of any such substance, and so that the user can apply any substance of choice to a fresh pad before use.

The substance to be applied to the body can be, for example, a lotion, cream, ointment, or solution. The substance can be medicated, if desired. The substance can be included as a component of a kit including the applicator device, disposable pads, and disposable pad engagement members.

There has been disclosed herein a device for applying a substance to difficult to reach portions of the body. The elements and the features of the invention are described herein with respect to obtaining those objectives, however, the basic structure of the invention may be modified to carry out those objectives. Thus, references herein to specific details of the illustrated embodiment are by way of example and not by way of limitation. It will be apparent to those skilled in the art that many modifications of the basic illustrated embodiment may be made without departing from the spirit and scope of the invention as recited by the claims.

The invention claimed is:

1. A device for applying a solution to a body, the device comprising a handle having a first end and a second end, wherein the handle comprises a plurality of interlocking segments of a generally tubular configuration each having a hollow interior region, with one of the segments including the first end of the handle and another of the segments including the second end of the handle; an elastic connect or extending through the hollow interior regions from the first end of the handle to the second end of the handle; and a head portion rotatable in three dimensions attached to the first end of the handle, the head portion having releasably-mounted on one surface a disposable pad engagement member, wherein the disposable pad engagement member is releasably attached to a pad pre-saturated with the solution.

2. The device of claim 1, wherein the handle is collapsible.

3. The device of claim 1, wherein the disposable pad engagement member is releasably attached to the head portion through a field of loops or field of hooks is adhesively mounted to the head portion.

4. The device of claim 1, wherein the head portion comprises a first surface on which a field of loops or field of hooks is mounted, and a second surface opposed to the first surface, wherein the head portion is rotatably mounted to the handle extending from the second surface.

5. The device of claim 4, wherein the first end of the handle has a substantially spherical knob and the second surface of the head portion is a socket capable of receiving the substantially spherical knob.

6. The device of claim 5, wherein the substantially spherical knob and the socket are mountable together in releasable snap-fitting relationship.

7. The device of claim 1, wherein the solution is medicated.

8. A kit for applying a solution to the body, the kit comprising the device of claim 1 and a container with one or more disposable pads in a solution.

9. A device for applying a solution to a body, the device comprising a handle having a first end and a second end, wherein the handle comprises a plurality of interlocking segments of a generally tubular configuration each having a hollow interior region, with one of the segments including the first end of the handle and another of the segments including the second end of the handle; an elastic connector extending through the hollow interior regions from the first end of the handle to the second end of the handle; and a head portion rotatable in three dimensions attached to the first end of the handle, the head portion having releasably-mounted on one surface a disposable pad engagement member.

* * * * *

UNITED STATES PATENT AND TRADEMARK OFFICE

CERTIFICATE OF CORRECTION

PATENT NO. : 8,015,653 B2
APPLICATION NO. : 11/331250
DATED : September 13, 2011
INVENTOR(S) : Michael Bargiel et al.

It is certified that error appears in the above-identified patent and that said Letters Patent is hereby corrected as shown below:

Column 4, line 11 of the claims, in the phrase "an elastic connect or extending" remove space between words "connect" and "or" to form word "connector".
Column 4, line 22 of the claims, after "field of hooks" remove the word "is".

Signed and Sealed this
Eighth Day of November, 2011

David J. Kappos

David J. Kappos
*Director of the United States Patent and Trademark Office*